US005472129A

United States Patent [19]

Yagawa

[11] Patent Number: 5,472,129

[45] Date of Patent: Dec. 5, 1995

[54] TEMPLATE FOR GUIDING A PLURALITY OF WIRES

[75] Inventor: Hiroshi Yagawa, Tokyo, Japan

[73] Assignee: The Whitaker Corporation, Wilmington, Del.

[21] Appl. No.: 116,415

[22] Filed: Sep. 3, 1993

[30] Foreign Application Priority Data

Nov. 17, 1992 [JP] Japan ..... 4-079174 U

[51] Int. Cl.[6] ..... B65H 23/04; B65H 57/00; B21F 3/00

[52] U.S. Cl. ..... 226/196; 242/157 R; 140/92.1

[58] Field of Search ..... 242/157 R, 615.4; 226/196, 199; 29/749, 753; 140/92.1

[56] References Cited

U.S. PATENT DOCUMENTS

| | | | |
|---|---|---|---|
| 3,866,296 | 2/1975 | Tucci | 29/753 X |
| 3,872,567 | 3/1975 | Cea et al. | 29/749 X |
| 3,980,251 | 9/1976 | Wyatt | 242/157 R |
| 4,043,017 | 8/1977 | Folk et al. | 29/749 |
| 4,441,251 | 4/1984 | Grubb | 29/749 X |
| 4,476,628 | 10/1984 | Kees, Jr. | 29/749 X |
| 4,505,034 | 3/1985 | Reidt | 29/749 |
| 4,551,893 | 11/1985 | Ikeda et al. | 29/749 X |
| 4,614,028 | 9/1986 | Rich | 29/749 |
| 5,010,642 | 4/1991 | Takahashi et al. | 29/749 X |

FOREIGN PATENT DOCUMENTS

| | | | |
|---|---|---|---|
| 2937689 | 6/1980 | Germany | 29/749 |

*Primary Examiner*—Daniel P. Stodola
*Assistant Examiner*—Michael R. Mansen
*Attorney, Agent, or Firm*—Adrian J. LaRue; Timothy J. Aberle

[57] ABSTRACT

The template (90) comprises a comb member (91) formed with guide grooves (91*a*) for guiding two of the plurality of electrical wires in the direction of movement, comb member (92) formed with guide grooves to guide three electrical wires to the predetermined direction, a comb member (93) to shift two electrical wires by one pitch thereof, a comb member (94) to shift three electrical wires by one pitch thereof, spacers (95), (96) disposed at both sides of the comb member (94), spacers (97, 98) disposed at both sides of the comb member (93), and a substrate (100) to arrange and hold the above comb members and the spacers.

5 Claims, 7 Drawing Sheets

TEMPLATE FOR GUIDING A PLURALITY OF WIRES

The present invention relates to a template for guiding the direction of traveling (or feeding) of a plurality of electrical wires, and also relates to changing the direction of traveling of a part of the electrical wires in making harnesses which are made by insulation displacing such electrical wires to electrical connectors.

BACKGROUND OF THE INVENTION

Known conventional harness making apparatus comprises providing a plurality of electrical wires which are continuously fed in a flat plane to be terminated to connectors, and then cut at a desired length after insulation displacing to connectors. Some harness-making apparatuses are adapted to make harnesses comprising electrical wires terminated to connectors at both ends of the electrical wires.

Firstly, as illustrated in prior art FIGS. 9A and 9B, these are harnesses made of electrical wires which are terminated to connectors at both ends. A harness 10, illustrated in FIG. 9(A), comprises identical connectors 14 at both ends of a plurality of electrical wires 12. Each of the connectors 14 is provided with electrical terminals (not shown) to which electrical wires 12 are electrically connected or terminated. On the other hand, the harness 20 as illustrated in FIG. 9(B) comprises electrical wires 22 terminated to a connector 24 at one end of the electrical wires 22, and to a plurality of connectors 26*a*, 26*b*, 26*c* and 26*d* at the other end. Each connector 24, 26*a*, 26*b*, 26*c* and 26*d* is provided with electrical terminals (not shown) to be electrically connected to the electrical wires 22. Other than the types of harnesses described hereinabove, there are so-called multi-harnesses comprising a small number of connectors having a large number of electrical terminals which are connected to one end of electrical wires and also a large number of connectors with a limited number of electrical terminals connected to the other end of the electrical wires, as illustrated in FIGS. 3 through 8 which are described hereunder.

Now, a reference is made to FIGS. 10 through 13 to describe a harness making apparatus for making the above discussed multi-harnesses.

A harness making apparatus 30 comprises, as illustrated in FIG. 10: a substrate 32; a first wire processing section 50 mounted on the substrate 32 for applying a plurality of connectors 60 (see FIG. 11) at leading ends of electrical wires 34; a second wire processing section 70 mounted on the substrate 32 for applying a plurality of connectors 62 (see FIG. 11) to trailing ends of the electrical wires 34; and a wire shuttle 40 horizontally moving back and forth between the first and second wire processing sections 50, 70 while holding the leading ends of the electrical wires 34. Also provided with the harness making apparatus 30 is a template 80 removably mounted on a frame 51. The template 80 has guide grooves 82 (see FIG. 13) for guiding the plurality of electrical wires 34 traveling in parallel with one another in a common plane, and a wire feeder (not shown) for selectively feeding the plurality of electrical wires 34 to the first and second wire processing sections 50, 70. It is to be noted that the harness making apparatus 30 is provided with a connector accommodation box 36 to accommodate a large number of connectors to be fed to the first and second wire processing sections 50, 70.

Illustrated in FIG. 11 is a magnified partial side view of the harness making apparatus as illustrated in FIG. 10. FIG. 12 is a magnified partial cross-section view to demonstrate the operation of the template.

As illustrated in FIG. 11, provided with the wire shuttle 40 are a wire clamp 41, to hold the electrical wires 34 (see FIG. 10) to be fed thereto, two shafts 42 slidably supported at both ends of the wire clamp 41, and a header 43 mounted at the front ends of the shafts 42 for holding the leading ends of the traveling electrical wires 34 (see FIG. 10). Since the leading ends of the traveling electrical wires 34 are clamped by the header 43 (see FIG. 10), as the wire shuttle 40 moves toward the first wire processing section 50, the header 43 is guided by a header guide plate 81 mounted on the template 80 as illustrated in FIG. 12, thereby abutting the front face of the header 43 against the rear face of the template 80 for ejecting the electrical wires 34 into the template 80 from the front face of the header 43.

A plurality of guide grooves 82 are formed in the template 80 for guiding the electrical wires 34 to be ejected or exiting from the front face of the header 43 as illustrated in FIG. 13, thereby properly guiding the electrical wires 34 to the plurality of electrical terminals (not shown) in the connector 60 through the guide grooves 82 which are equal in pitch with the electrical terminals. Also provided on the bottom face of the template 80 is a bottom plate 83 which is slidable with respect to the bottom face as illustrated in FIG. 12, thereby properly positioning the electrical wires 34 to the guide grooves 82 over the connector 60 without hanging down as illustrated in FIG. 12. When the electrical wires 34 are guided over the connector 60, the bottom plate 83 slides laterally to the right on the sheet. The leading ends of the electrical wires 34 are transferred onto the electrical terminals (not shown) in the connector 60. Immediately thereafter, a stuffer blade 52 goes down to push the electrical wires 34 into the electrical terminals (not shown) in the connector 60 for insulation displacing the electrical wires to the connector 60. In this manner, the leading ends of a plurality of electrical wires 34 are guided by the template 80 in the pitch of the electrical terminals in the connector 60 for properly insulation displacing the electrical wires 34. It is to be noted that the trailing ends of the electrical wires 34 are also insulation displaced to another connector 62 by pushing down a wire guide arm 71 and a stuffer blade 72 at the second wire processing section 70 as illustrated in FIG. 1 of U.S. Pat. No. 4,551,893.

The harness making apparatus 30 is a type to guide the electrical wires at the first wire processing section 50 by mounting the template 80 at the first wire processing section 50. It is also possible to apply the template 80 to the second wire processing section 70 for guiding the electrical wires therein.

Examples of multi-harnesses made by the above harness making apparatus 30 are illustrated in FIGS. 3 through 8. There are 600 or more variations depending on the number of electrical terminals of a plurality of connectors, pitches of electrical terminals, and combinations of connectors to which parts of electrical wires 34 are terminated at the first wire processing section 50. The conventional harness making apparatus for making such various forms of multi-harnesses are using unitary templates for guiding a plurality of electrical wires 34 at the first wire processing section 50. That is, each of them is made of a unitary block having guide grooves of predetermined number and configuration as illustrated in FIG. 13. Accordingly, this means that 600 or more kinds of templates may be needed depending on particular multi-harnesses to be made. The templates which are not for the harnesses under production must be stocked.

It is difficult to stock or maintain 600 or more templates and also to timely supply a particular template that a customer needs.

In consideration of the above situation, it is an object of the present invention to provide a template which requires minimum number of parts to be stocked, is capable of easily preparing to meet customers needs, and is also capable of assembling in a field or the place where the multi-harnesses are to be made.

SUMMARY OF THE INVENTION

In order to achieve the above object, the template according to the present invention has a plurality of guide grooves for guiding a plurality of electrical wires traveling in a predetermined direction in a common plane and features in combination:

(1) first comb members each having a plurality of guide grooves for guiding a part of electrical wires in a predetermined direction;

(2) second comb members each having a plurality of guide grooves for guiding a part of the electrical wires in a different direction from the predetermined direction in the plane;

(3) spacers disposed between the first and second comb members; and (4) a substrate for aligning and retaining the first comb members, second comb members and spacers in a row perpendicular to the predetermined direction;

whereby the first comb members, the second comb members and the spacers are aligned and held in the substrate so that a plurality of electrical wires are guided by the first and second comb members.

The template according to the present invention is provided with first comb members having guide grooves for guiding a part of a plurality of electrical wires traveling in a predetermined direction in a common plane, second comb members having guide grooves for guiding the remaining electrical wires in a different direction but in the same plane, and spacers disposed between the first and second comb members. Accordingly, such components are assembled in a desired pattern to adapt the intended multi-harnesses to be made. That is, the electrical wires are aligned and held in the substrate in a line perpendicular to the predetermined direction so that the electrical wires can be guided by the first and second comb members, thereby making any template adaptable to the all of the multi-harnesses to be made. This will eliminate time consuming maintenance and management of 600 or more templates conventionally required. Since any template to fit any particular multi-harnesses can be assembled by preparation of a plurality of first comb members, second comb members and spacers, any template required in the plant for making such multi-harnesses can be assembled at the site.

Now, the template according to one embodiment of the present invention will be described by reference to the accompanying drawings.

DETAILED DESCRIPTION OF THE PREFERRED EMBODIMENT(S)

FIG. 1(A) illustrates an exploded perspective view of the template according to one embodiment of the present invention. FIG. 1(B) illustrates a magnified front view of one of the comb members, and FIG. 2 is a perspective view of an assembled template mounted on a harness making apparatus 30 (see FIG. 10).

Figure 1A:
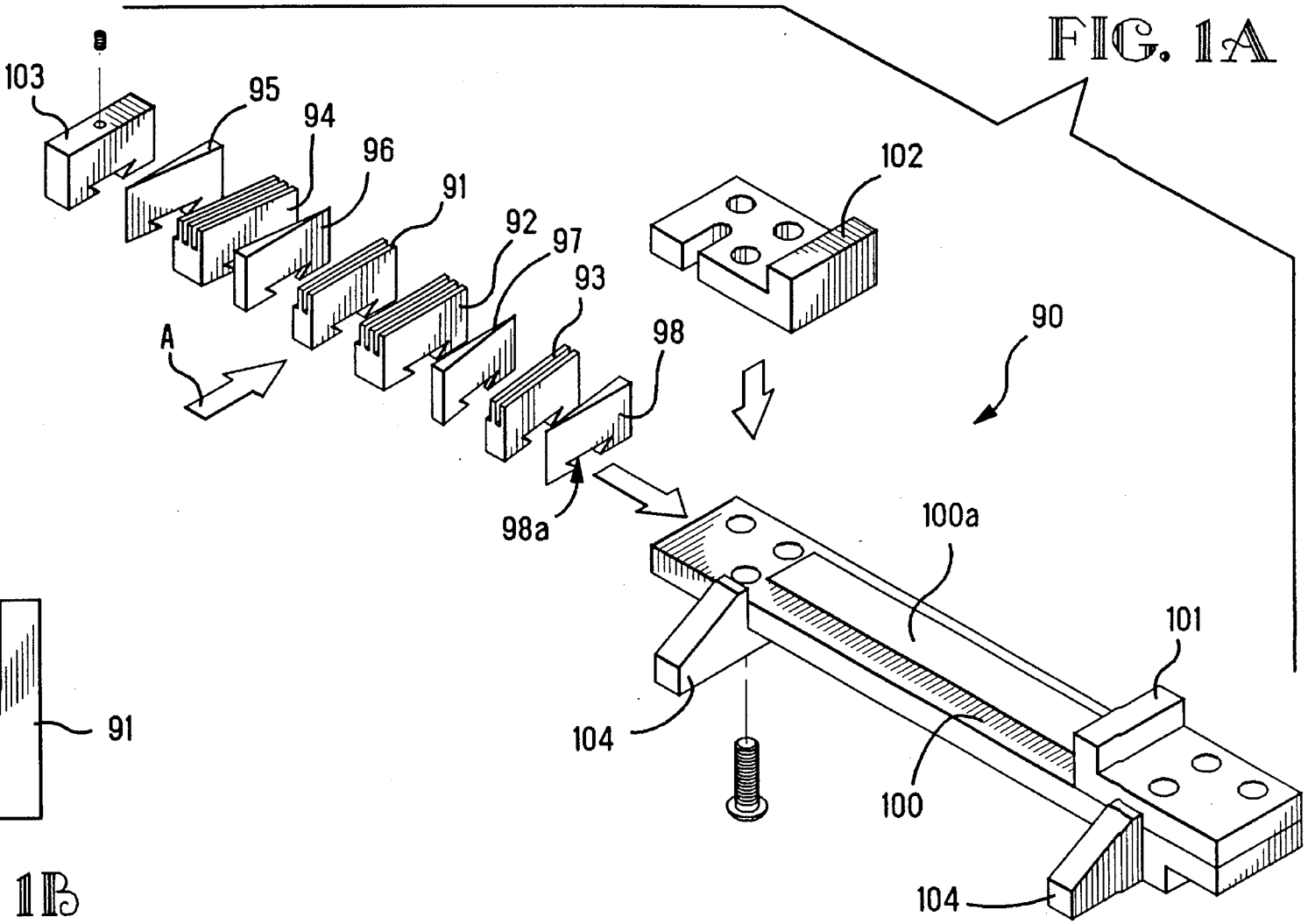
FIG. 1(A) is an exploded perspective view of one embodiment of the template and FIG. 1(B) is a front view of one of the comb members.
Figure 1B:
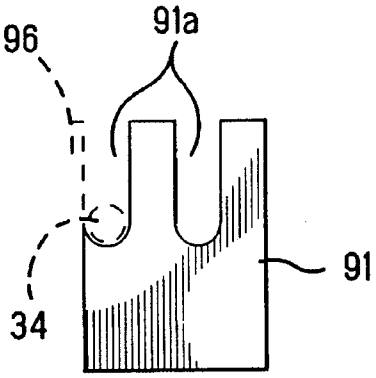
Figure 2:
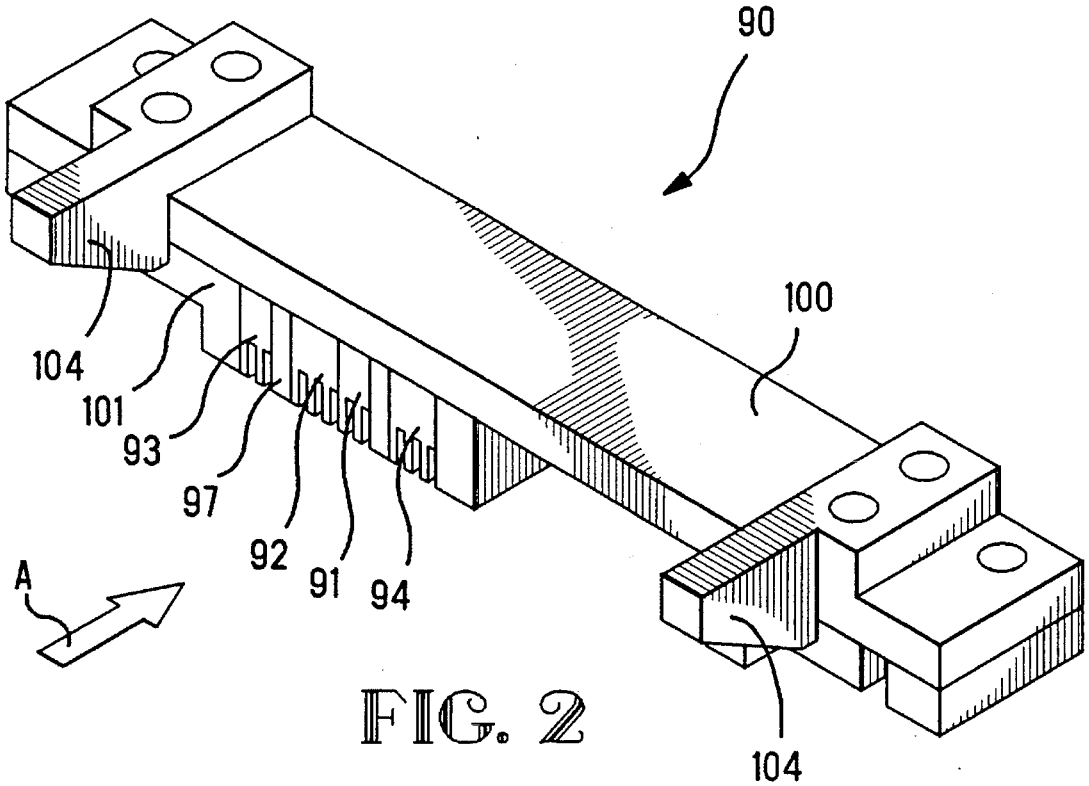
FIG. 2 is a perspective view of one example of the assembled template.

The template 90 is provided with a comb member 91 having guide grooves 91*a* for guiding two of a plurality of electrical wires 34 (see FIG. 10) traveling to a predetermined direction (as shown by an arrow A) in parallel in a common plane to the predetermined direction and also a comb member 92 having guide grooves for guiding three electrical wires to the predetermined direction. Also provided are comb members 93 and 94 for respectively guiding two and three electrical wires not to the predetermined direction but to a different direction from the predetermined direction by one pitch of the electrical wires. Additionally, disposed at both sides of the comb member 94 are spacers 95, 96 and both sides of the comb member 93 are spacers 97, 98. Also, the comb members 91, 92, 93 and 94 and the spacers 95, 96, 97, 98 are formed with mating grooves (only 98*a* for the spacer 98 is illustrated) for mating with a rail 100*a* of the substrate 100 as described hereinafter. A plurality of such comb members 91, 92, 93, and 94 and the spacers 95, 96, 97 and 98 are prepared for proper combination to obtain the template to fit particular forms of various multi-harnesses as illustrated in FIGS. 3 through 8 which will be described hereinafter.

Additionally, the template 90 is provided with a substrate 100 for aligning and holding the above mentioned comb members and spacers. The substrate 100 is provided with a rail 100a for mating with the mating grooves in the comb members 91 through 94 and the spacers 95 through 98, thereby aligning the comb members 91 through 94 in the orthogonal direction to the predetermined direction as illustrated by an arrow A so that a plurality of electrical wires 34

(see FIG. 10) can be guided. Also, the substrate 100 is provided with retention members 101, 102, for holding the aligned comb members 91 through 94 and the spacers 95 through 98 by mounting at both ends, thereby maintaining the comb members 91 through 94 and the spacers 95 through 98 in a line. Mounted at both ends of the substrate 100 are header guide plates 104 having the similar function as the header guide plate 81 as illustrated in FIG. 11.

The above comb members are illustrated to have two and three guide grooves. However, a combination of these comb members will enable providing any desired number of guide grooves required for multi-harnesses other than those having only one guide groove. It is of course possible to reduce the number of required comb members by increasing the number of guide grooves in each comb member.

By reference now to FIGS. 3 through 8, illustrated therein are examples of multi-harnesses made by the harness making apparatus 30 (see FIG. 10) using the template according to the present invention.

Figure 3:
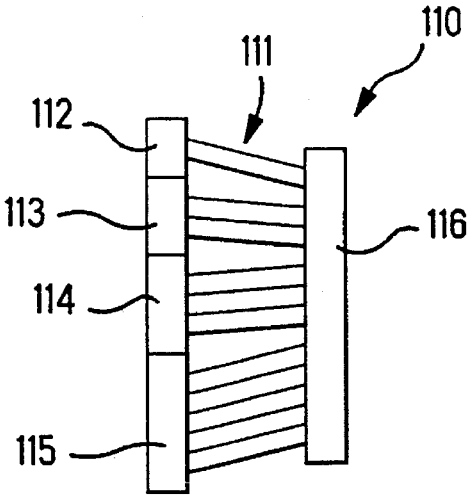
FIG. 3 is a simplified view of one example of multi-harnesses to be made by using the template according to the present invention.

Illustrated in FIG. 3 is a multi-harness 110 in which 15 electrical wires 111 traveling in parallel in a common plane are terminated to four connectors 112, 113, 114 and 115 with respectively 2, 3, 4 and 6 wires at the second wire processing section 70 and then terminated to a single connector 116 at the first wire processing section 50. The comb member for the template for making the multi-harness 110 is made by disposing a comb member to shift the electrical wires to be connected to the electrical connector 112 by 2 pitches upwardly, a comb member to shift the electrical wires to be connected to the connector 113 by 1 pitch upwardly, a comb member guiding the electrical wire to be connected to the connector 114 without any shift, a comb member to shift the electrical wires to be connected to the connector 115 by 1 pitch downwardly and spacers expanding in the direction of movement of the electrical wires each disposed between adjacent comb members.

Figure 4:
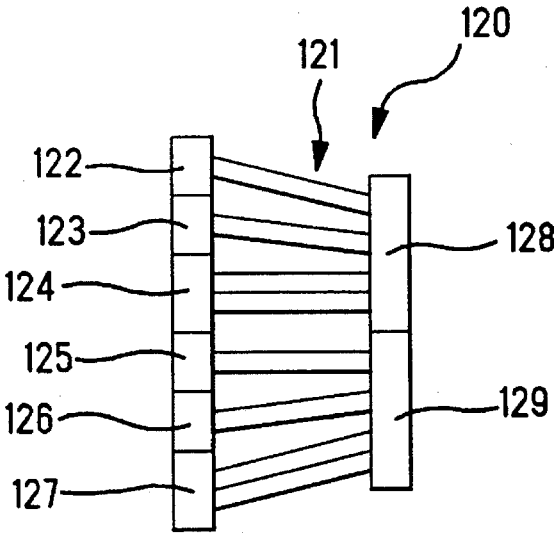
FIG. 4 is a simplified view of another example of multi-harnesses to be made by using the template according to the present invention.
Figure 10:
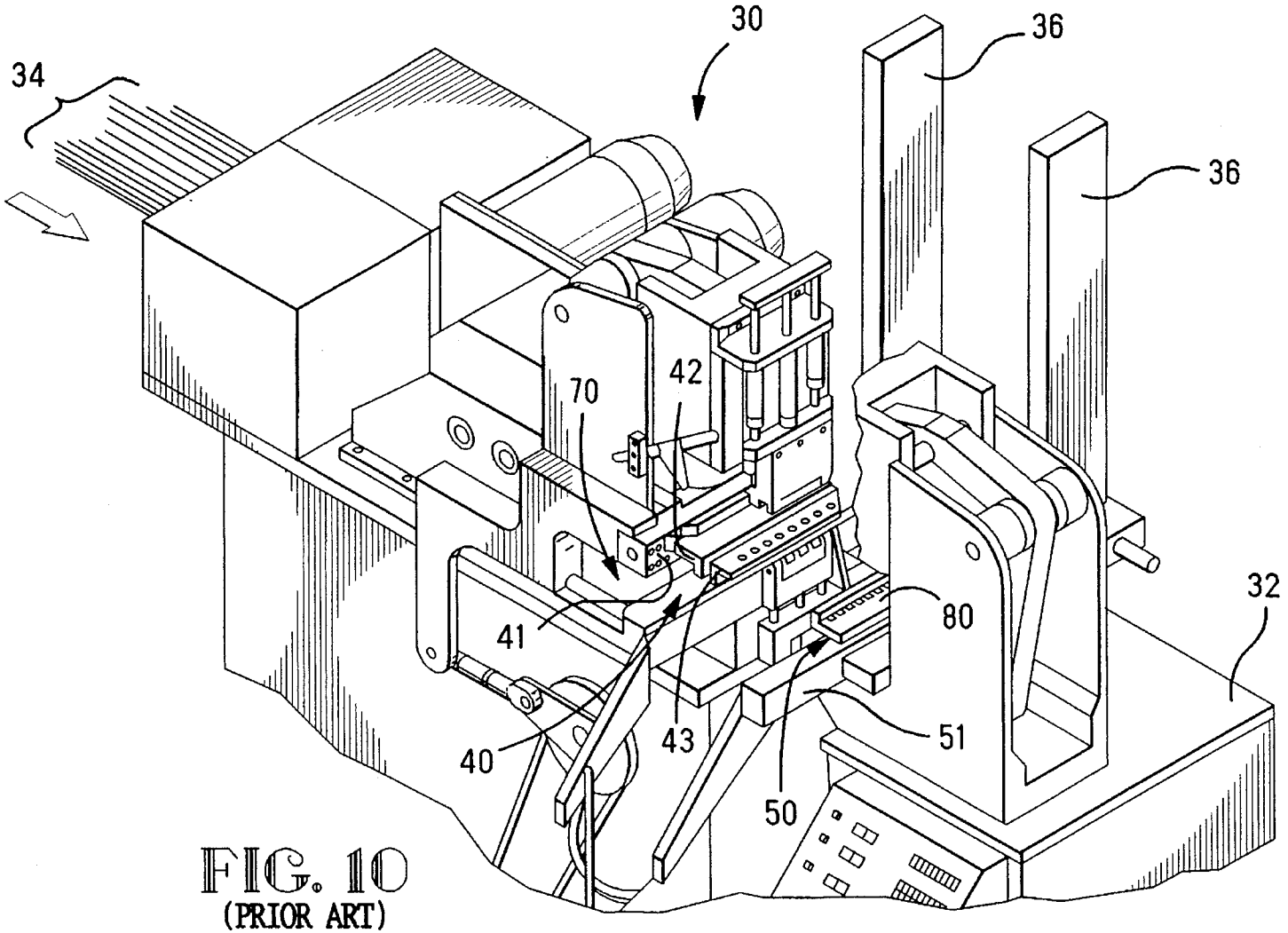
FIG. 10 (PRIOR ART)
FIG. 10 is a perspective view of a harness making apparatus.
Figure 11:
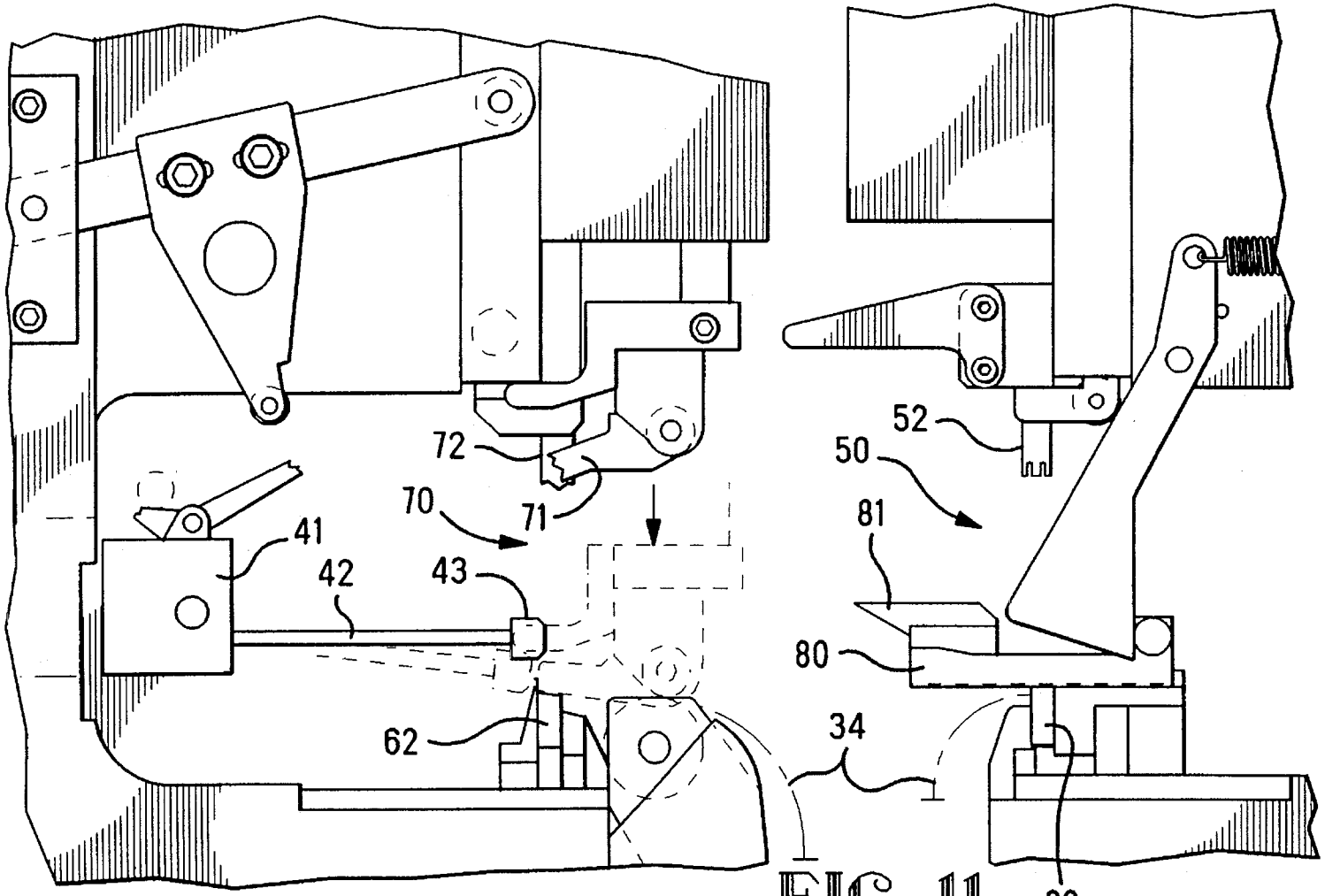
FIG. 11 (PRIOR ART)
FIG. 11 is a magnified side view of one part of the harness making apparatus illustrated in FIG. 10.
Figure 12:
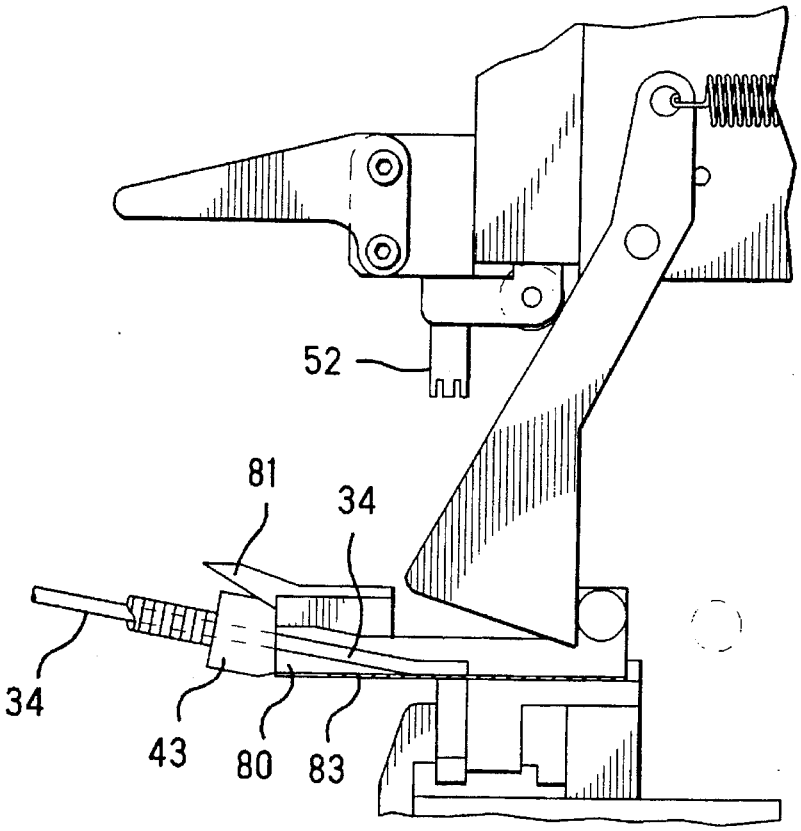
FIG. 12 ( PRIOR ART )
FIG. 12 is a partial magnified cross section view to show the operation of the template.
Figure 13:
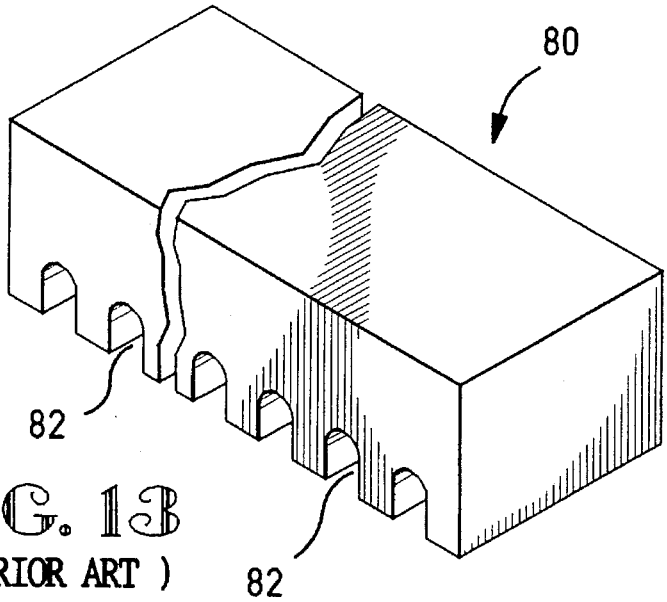
FIG. 13 ( PRIOR ART )
FIG. 13 is a perspective view illustrating a general construction of the known template.

FIG. 4 illustrates a multi-harness 120 comprising six connectors 122, 123, 124, 125, 126 and 127 to which parallel fed 2, 2, 3, 2, 2 and 3 electrical wires 121 are respectively terminated at the first wire processing section 70 (see FIG. 10) and also terminated to two connectors 128, 129 at the second wire processing section 50 (see FIG. 10). The comb member for the template to make such multi-harness 120 is made of a comb member to shift the electrical wires to be connected to the connector 122 by 2 pitches upwardly, a comb member to shift the electrical wire to be connected to the connector 123 by one pitch upwardly, comb members to guide the electrical wires to be connected to the connectors 124, 125 without any shift, a comb member to shift the electrical wires to be connected to the connector 126 by one pitch downwardly, a comb member to shift the electrical wires to the connectors 127 by 2 pitches downwardly and spacers one each between adjacent comb members.

Figure 5:
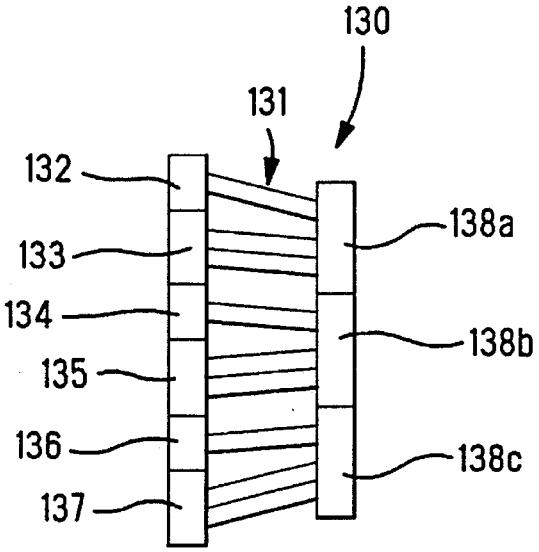
FIG. 5 is a simplified view of still another example of multi-harnesses to be made by using the template according to the present invention.

Illustrated in FIG. 5 is a multi-harness 130 comprising 15 electrical wires 131 traveling in parallel in a common plane to be terminated to six connectors 132, 133, 134, 135, 136 and 137 with respectively 2, 3, 2, 3, 2 and 3 wires at the second wire processing section 70 (see FIG. 10) and terminated to three connectors 138*a*, 138*b* and 138*c* at the first wire processing section 50 (see FIG. 10). The comb member for the template to make such a multi-harness 130 is made of a comb member to shift the electrical wires to be connected to the connector 132 by 2 pitches upwardly, comb members to shift the electrical wires to be connected to the connectors 133, 134 by a single pitch upwardly, comb members to shift the electrical wires to be connected to the connectors 135, 136 by a single pitch downwardly, a comb member to shift the electrical wires to be connected to the connector 137 by two pitches downwardly downwardly, and spacers to be disposed between adjacent comb members to adapt the shift of the pitch.

Figure 6:
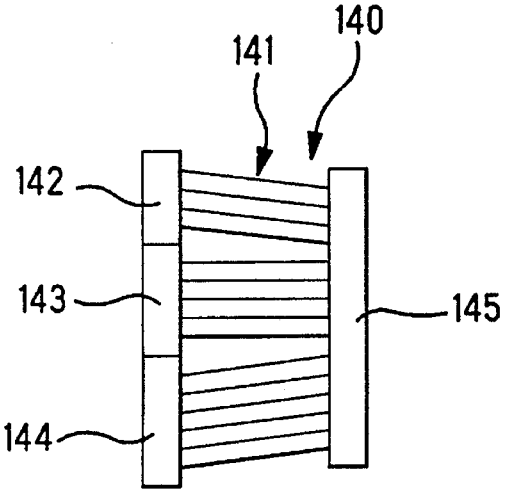
FIG. 6 is a simplified view of yet another example of multi-harnesses to be made by using the template according to the present invention.

Illustrated in FIG. 6 is a multi-harness 140 comprising 15 electrical wires 141 traveling in parallel in a common plane to be connected to three connectors 142, 143 and 144 with 4, 5 and 6 electrical wires respectively at the second wire processing section 70 (see FIG. 10) and connected to a single connector 145 at the first wire processing section 50 (see FIG. 10). The comb member for the template to be used for making the multi-harness 140 is made of a comb member to shift the electrical wires to be connected to the connector 142 by a single pitch upwardly, a comb member to guide the electrical wires to be connected to the connector 143 without shifting, a comb member to shift the electrical wires to be connected to the connector 144 by a single pitch downwardly, and spacers expanding in the direction of movement of the electrical wires between adjacent comb members.

Figure 7:
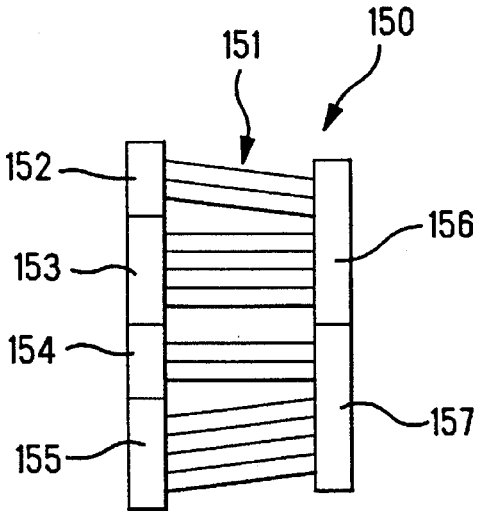
FIG. 7 is a simplified view of a further example of multi-harnesses to be made by using the template according to the present invention.

FIG. 7 illustrates a multi-harness 150 comprising 16 electrical wires 151 traveling in parallel in a common plane 3, 5, 3 and 5 of which are terminated respectively to four connectors 152, 153, 154 and 155 at the second wire processing section 70 (see FIG. 10) and also terminated to two connectors 156, 157 at the first wire processing section 50 (see FIG. 10). The comb member for the template to be used for making the multi-harness 150 is made of a comb member shifting the electrical wires to be terminated to the connector 152 by a single pitch upwardly, comb members guiding the electrical wires to be terminated to the connectors 153, 154 without shifting, a comb member shifting the electrical wires to be terminated to the connector 155 by a single pitch downwardly, and spacers each disposed between adjacent comb members to adapt any shift of the arrangement of the electrical wires.

Figure 8:
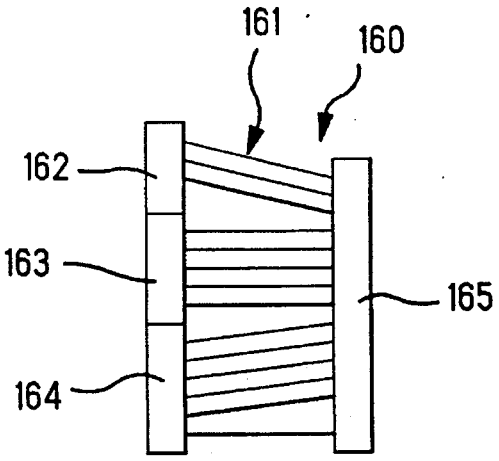
FIG. 8 is a simplified view of yet a further example of multi-harnesses to be made by using the template according to the present invention.
Figure 9A:
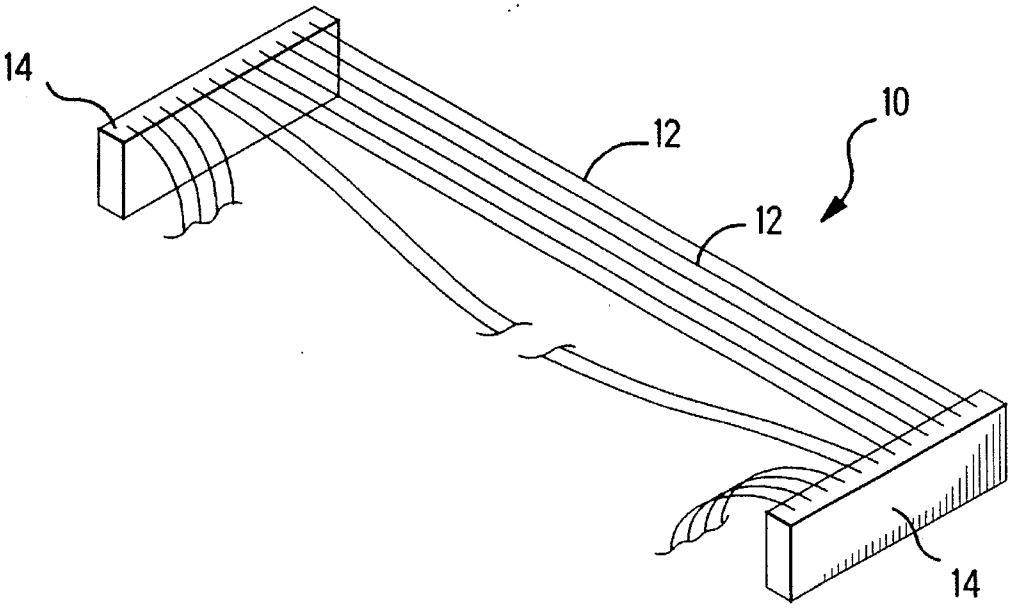
FIG. 9A (PRIOR ART)
FIGS. 9A and 9B show prior art, perspective views, of harnesses having connectors at both ends of the electrical wires.
Figure 9B:
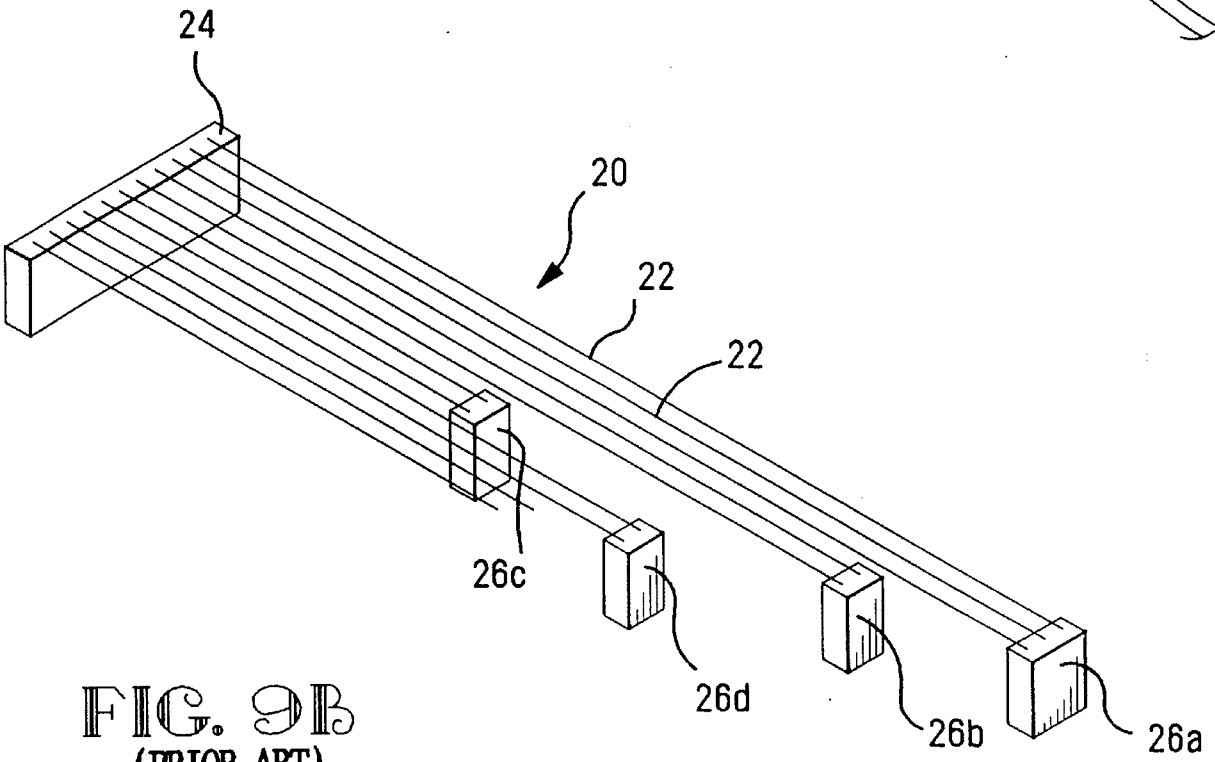
FIG. 9B (PRIOR ART)

Illustrated in FIG. 8 is a multi-harness 160 comprising 14 electrical wires 161 fed in parallel in a common plane which are separated to be 3 groups of 3, 5, and 6 wires to be terminated respectively to three connectors 162, 163 and 164 at the second wire processing section 70 (see FIG. 10) and terminated at the other ends to a single connector 165 at the first wire processing section 50 (see FIG. 10). The comb member for the template to be used for making the multi-harness 160 is made of a comb member shifting the electrical wires to be terminated to the connector 162 by 2 pitches upwardly, a comb member guiding the electrical wires to be terminated to the connector 163 without shifting, a comb member guiding the electrical wires to be terminated to the connector 164 partly shifting one pitch downwardly and also without shifting, and spacers between the adjacent comb members to match the spacing.

It is to be noticed that in some of the multi-harnesses, e.g., the multi-harness 120 in FIG. 4, the electrical wires are not terminated at a constant pitch which thereby creates an open position equal to one wire between the connectors 128, 129 to be terminated at the first wire processing section 50 (see FIG. 10). An arrangement is made in a wire feeder (not shown) not to feed the electrical wire to this open position.

As described hereinbefore, the present invention is useful in the preparation of a plurality of comb members to guide the electrical wires without shifting, shifting one or two pitch of the pitch of the electrical wires either upwardly or downwardly, and also provides spacers to adapt the shift in arrangement. They are properly arranged and held in a substrate for assembling templates to adapt various multi-harnesses. There are 600 or more kinds of multi-harnesses. It was very difficult and expensive to prepare and maintain templates to fit such conventional multi-harnesses. However, the present invention enables one to assemble desired templates at the sites of making such multi-harnesses by using a limited number of parts, thereby eliminating complicated maintenance or inventory control.

I claim:

1. A template for guiding a plurality of electrical wires to be fed in a predetermined direction, comprising in combination:

first comb members having only guide grooves disposed substantially parallel with the wire feeding direction to guide some of the wires;

second comb members having only guide grooves slanted with respect to the wire feeding direction to guide the rest of the wires;

spacers to be disposed between said comb members;

a substrate for arranging and holding said first and second comb members and said spacers perpendicular to the wire feeding direction, wherein said first and second comb members and said spacers are adapted to be interchangeably arranged in a desired combination on the substrate.

2. The template of claim 1, wherein said spacers are wedge shaped.

3. The template of claim 1, wherein said substrate includes a rail and said first and second comb members and said spacers have engaging grooves for matingly engaging the rail.

4. The template of claim 1, wherein said substrate includes retention members for holding said first and second comb members and said spacers in a line on said substrate.

5. The template of claim 1, wherein each of said first and second comb members have two guide grooves or three guide grooves.

* * * * *